US010272456B2

(12) United States Patent
Isomi et al.

(10) Patent No.: US 10,272,456 B2
(45) Date of Patent: Apr. 30, 2019

(54) SPRAYING APPARATUS

(71) Applicant: Panasonic Intellectual Property Management Co., Ltd., Osaka (JP)

(72) Inventors: Akira Isomi, Osaka (JP); Daisuke Tabata, Osaka (JP); Yuki Ueda, Osaka (JP)

(73) Assignee: Panasonic Intellectual Property Co., Ltd., Osaka (JP)

( * ) Notice: Subject to any disclaimer, the term of this patent is extended or adjusted under 35 U.S.C. 154(b) by 347 days.

(21) Appl. No.: 15/413,724

(22) Filed: Jan. 24, 2017

(65) Prior Publication Data

US 2017/0266674 A1 Sep. 21, 2017

(30) Foreign Application Priority Data

Mar. 17, 2016 (JP) ..... 2016-054169
Sep. 26, 2016 (JP) ..... 2016-187271

(51) Int. Cl.
*B05B 7/04* (2006.01)

(52) U.S. Cl.
CPC ..... *B05B 7/0483* (2013.01); *B05B 7/0441* (2013.01); *B05B 7/0458* (2013.01)

(58) Field of Classification Search
CPC .... B05B 7/0483; B05B 7/0441; B05B 7/0458
USPC ..... 239/423, 424, 433
See application file for complete search history.

(56) References Cited

U.S. PATENT DOCUMENTS 5,046,668 A 9/1991 Ikeuchi et al.
5,810,252 A * 9/1998 Pennamen ..... B05B 7/0441 239/423
6,902,122 B2 * 6/2005 Boersen ..... B05B 7/061 239/424
2003/0089734 A1 5/2003 Eberhardt et al.
2006/0027595 A1 2/2006 Eberhardt et al.
(Continued)

FOREIGN PATENT DOCUMENTS

CN 201140125 Y 10/2008
JP 2-273565 11/1990
(Continued)

OTHER PUBLICATIONS

English Translation of Chinese Search Report dated Nov. 28, 2018 for the related Chinese Patent Application No. 201710040567.5.

*Primary Examiner* — Steven J Ganey
(74) *Attorney, Agent, or Firm* — Panasonic IP Management; Kerry S. Culpepper

(57) ABSTRACT

A spraying apparatus includes: an inner lid; a flow guide plate; and an annular member, wherein a liquid is introduced into a gas -liquid mixing section between the inner lid, the flow guide plate, and the annular member from an inner lid plate of the inner lid, the inner lid plate being a flat plate located upstream of the spraying apparatus and proximate the gas-liquid mixing section, and a gas is introduced into the gas-liquid mixing section from an opposite position, the liquid is atomized in the gas-liquid mixing section by the liquid impinging with the gas and transforming into a gas-liquid mixed fluid, and advancing to a spouting portion as the gas-liquid mixed fluid is circulated in the gas-liquid mixing section along the internal surface of the annular member on the flow guide plate and facing the gas-liquid mixing section.

10 Claims, 12 Drawing Sheets

(56) References Cited

U.S. PATENT DOCUMENTS

| | | | |
|---|---|---|---|
| 2007/0164056 | A1 | 7/2007 | Eberhardt et al. |
| 2008/0265062 | A1 | 10/2008 | Brown |
| 2009/0305178 | A1 | 12/2009 | Nakagawa et al. |
| 2014/0319246 | A1 | 10/2014 | Lehmann et al. |

FOREIGN PATENT DOCUMENTS

| | | |
|---|---|---|
| JP | 2001-149822 | 6/2001 |
| JP | 3099331 U | 4/2004 |
| JP | 2006-088219 | 4/2006 |
| JP | 2008-045776 | 2/2008 |

* cited by examiner

FIG. 6

| DIAMETER OF TUBULAR PASSAGEWAY (mm) | NUMBER OF TEETH | DIAMETER OF TIP CIRCLE (mm) | DIAMETER OF ROOT CIRCLE (mm) | NOISE VALUE (dB) |
|---|---|---|---|---|
| 1.0 | 6 | 1.0 | 1.7 | 75 |
| | | 1.5 | 2.6 | 76 |
| | | 2.0 | 3.4 | 77 |
| | | 2.5 | 4.3 | 78 |
| | | 3.0 | 5.1 | 79 |
| | | 3.5 | 6.0 | 80 |
| | | 4.0 | 6.0 | 80 |
| | | 4.5 | 6.0 | 80 |
| | 12 | 1.0 | 1.3 | 75 |
| | | 1.5 | 2.0 | 76 |
| | | 2.0 | 2.6 | 77 |
| | | 2.5 | 3.3 | 78 |
| | | 3.0 | 3.9 | 79 |
| | | 3.5 | 4.6 | 80 |
| | | 4.0 | 5.2 | 80 |
| | | 4.5 | 5.9 | 80 |
| 1.5 | 6 | 1.5 | 2.6 | 78 |
| | | 2.0 | 3.4 | 79 |
| | | 2.5 | 4.3 | 80 |
| | | 3.0 | 5.1 | 81 |
| | | 3.5 | 6.0 | 82 |
| | | 4.0 | 6.0 | 82 |
| | | 4.5 | 6.0 | 82 |
| | 12 | 1.5 | 2.0 | 78 |
| | | 2.0 | 2.6 | 79 |
| | | 2.5 | 3.3 | 80 |
| | | 3.0 | 3.9 | 81 |
| | | 3.5 | 4.6 | 82 |
| | | 4.0 | 5.2 | 82 |
| | | 4.5 | 5.9 | 82 |

FIG. 9

| DIHEDRAL ANGLE (DEGREE) | NOISE VALUE (dB) |
|---|---|
| 180 | 76 |
| 150 | 72 |
| 120 | 73 |
| 90 | 76 |
| 60 | 78 |
| 30 | 78 |

FIG. 10

| NUMBER OF TEETH WHERE DIHEDRAL ANGLE IS 150 DEGREES | NOISE VALUE (dB) |
|---|---|
| 0 | 76.0 |
| 1 | 75.8 |
| 2 | 75.3 |
| 3 | 74.7 |
| 6 | 72.0 |

SPRAYING APPARATUS

BACKGROUND

1. Technical Field

The present disclosure relates to a two-fluid nozzle spraying apparatus which atomizes a liquid using a gas.

2. Description of the Related Art

Nozzles for atomizing liquids are widely used in, for example, space/material cooling apparatuses, humidifying apparatuses, chemical solution dispensing apparatuses, combustion apparatuses, and dust control apparatuses. The atomization nozzles can be broadly divided into a single-fluid nozzle and a two-fluid nozzle. The single-fluid nozzle atomizes a liquid by spouting the liquid from a micro aperture. The two-fluid nozzle atomizes a liquid, using a gas such as an air, nitrogen, steam, etc. Comparing the single-fluid nozzle and the two-fluid nozzle, in general, the two-fluid nozzle is superior to the single-fluid nozzle in atomization performance because the two-fluid nozzle atomizes a liquid using energy of a gas.

As an example of the two-fluid nozzle which atomizes a liquid, for example, Japanese Unexamined Patent Application Publication No. 2001-149822 (PTL 1) discloses a two-fluid nozzle. The two-fluid nozzle disclosed in PTL 1, as illustrated in FIG. 12, has a triple-barrel structure comprising inner barrel 40, middle barrel 41, and outer barrel 42. Inner barrel 40 is formed of proximal barrel 43 and distal barrel 44 coupled with each other. A hollow portion of inner barrel 40 is referred to as center air passageway 45. An annular intermediate passageway between inner barrel 40 and middle barrel 41 is referred to as liquid passageway 46. An annular outer passageway between middle barrel 41 and outer barrel 42 is referred to as outer air passageway 47. Proximal opening 47*a* of outer air passageway 47 and proximal opening 45*a* of center air passageway 45 are connected to an air supply main not shown. Thus, low pressure air is introduced from a pneumatic pressure source configured of an air compressor, not shown, into proximal opening 47*a* and proximal opening 45*a* via the air supply main. Proximal opening 46*a* of annular liquid passageway 46 is connected to a water supply main not shown. Pressurized water is introduced from a liquid reservoir, not shown, into proximal opening 46*a* via the water supply main and a pump.

Distal barrel 44 included in inner barrel 40, middle barrel 41, and outer barrel 42 include distal portions 40*b*, 41*b*, and 42*b*, respectively, at respective distal ends. Distal portions 40*b*, 41*b*, and 42*b* have openings 40*a*, 41*a*, 42*a*, respectively, which are positioned collinearly along axis L. Opening 41*a* of middle barrel 41 is positioned within opening 42*a* of outer barrel 42. Opening 42*a* is a spout. Opening 40*a* of inner barrel 40 is positioned within opening 41*a* of middle barrel 41.

In inner barrel 40, distal barrel 44 is screwed into and connected to proximal barrel 43. Inner barrel 40 has inner barrel opening 40*a* at the tip, and small-diameter orifice 44*a* formed in the center of distal barrel 44 in the direction of axis L. Generally opposed two recessed grooves 44*c* are formed in distal surface 44*b* which defines the perimeter of opening 40*a* of inner barrel 40.

Distal portion 41*b* of middle barrel 41 has a conical external surface, and an internal surface having step 41*c*. Middle barrel 41 has, on the distal end side, a small-diameter hollow portion having a same diameter as and communicating with opening 40*a* of inner barrel 40. Middle barrel 41 has opening 41*a* at the tip. Opening 41*a* has a smaller diameter than the small-diameter hollow portion of middle barrel 41.

Step 41*c* in middle barrel 41 abuts distal surface 44*b* of inner barrel 40 such that step 41*c* and grooves 44*c* form three liquid swirling communication passageways 48. Liquid swirling communication passageways 48 open to a distal hollow portion of inner barrel 40 and communicating between the distal hollow portion of inner barrel 40 and a distal hollow portion of middle barrel 41. A distal hollow portion formed and communicating between inner barrel 40 and middle barrel 41 is referred to as first mixing chamber 49.

Distal portion 42*b* of outer barrel 42 is positioned widely spaced from distal portion 41*b* of middle barrel 41. Second mixing chamber 50 is formed between distal portion 41*b* of middle barrel 41 and distal portion 42*b* of outer barrel 42. Second mixing chamber 50 communicates with annular outer air passageway 47. Opening 42*a*, which is the spout, is located in the tip center of outer barrel 42.

In the nozzle as configured above, initially, water that enters liquid passageway 46 is swirled as it passes through liquid swirling communication passageways 48 and the swirl flow enters first mixing chamber 49. Thus, the water has been put through primary atomization by being swirled. The water that entered first mixing chamber 49 in a form of the swirl flow impinges and mixes with an air from an air compressor which has passed and spouted from orifice 44*a* of center air passageway 45. Thus, the water has been put through secondary atomization by impinging and mixing with the air, and a gas-liquid mixed fluid spouts from opening 41*a* of middle barrel 41 into second mixing chamber 50.

The gas-liquid mixed fluid resulted from the secondary atomization impinges and mixes, in second mixing chamber 50, with an air from an air compressor that enters through outer air passageway 47. A gas-liquid mixed mist resulted from the tertiary atomization in this manner in second mixing chamber 50 is sprayed through opening 42*a*, which is the spout, of outer barrel 42. In particular, owing to second mixing chamber 50 being a large space, the air that enters second mixing chamber 50 through outer air passageway 47 uniformly impinges and mixes with the gas-liquid mixed fluid that enters through opening 41*a* and the gas-liquid mixed fluid is also swirled, thereby uniformly atomizing water droplets (see PTL 1).

SUMMARY

However, a problem with the configuration of the conventional two-fluid nozzle disclosed in PTL 1 is that, despite of the complex nozzle structure, the liquid to be sprayed is not sufficiently atomized, ending up spraying a liquid having a large particle size. Specifically, the liquid sprayed through the two-fluid nozzle disclosed in PTL 1 has a particle size of 50 μm or greater. The liquid sprayed having a large particle size as such requires time to vaporize. In other words, an object sprayed with the liquid gets dripping wet due to late vaporization.

The present disclosure solves the conventional problem stated above and has an object to provide a spraying apparatus which sprays liquid which has a small particle size and vaporize so quickly that an object sprayed with the liquid does not get dripping wet. More specifically, an object of the present disclosure is to provide a two-fluid nozzle spraying apparatus which sprays a liquid which has a small particle size such as 10 μm or less and vaporizes so quickly that an object sprayed with the liquid do not get dripping wet.

In order to achieve the above object, according to one aspect of the present disclosure, a spraying apparatus is provided which includes: a spraying apparatus main body having a liquid passageway and a gas passageway; an inner lid which includes an inner lid plate, the inner lid being disposed on a distal end of the spraying apparatus main body and covering an opening of the liquid passageway, the inner lid plate being flat; an outer lid which includes an outer lid plate which is flat and faces the inner lid plate of the inner lid, the outer lid being disposed on the distal end of the spraying apparatus main body and covering the inner lid and an opening of the gas passageway; an annular member which is disposed between the inner lid and the outer lid and forms a gas-liquid mixing section which is a space and has a disc-shaped profile; a flow guide plate disposed between the gas-liquid mixing section and the outer lid and having a through hole communicating with the gas-liquid mixing section; a liquid inlet for introducing the liquid through the liquid passageway into the gas-liquid mixing section, the liquid inlet passing through the inner lid plate of the inner lid in an edge portion of the inner lid plate and communicating with the gas-liquid mixing section; a gas inlet for introducing the gas through the gas passageway into the gas-liquid mixing section to the liquid that entered the gas-liquid mixing section through the liquid inlet, the gas inlet communicating with the gas-liquid mixing section; and a spouting portion for spouting a liquid atomized by the gas and the liquid being mixed in the gas-liquid mixing section, the spouting portion communicating with the gas-liquid mixing section and the through hole in the flow guide plate and passing through the outer lid plate of the outer lid.

As such, according to the spraying apparatus of the above aspect of the present disclosure, the spraying apparatus is provided which sprays a liquid which has a small particle size and vaporizes so quickly that an object sprayed with the liquid does not get dripping wet. More specifically, the two-fluid nozzle spraying apparatus can be provided which sprays a liquid which has a small particle size such as 10 pm or less and vaporizes so quickly that an object sprayed with the liquid do not get dripping wet.

BRIEF DESCRIPTION OF THE DRAWINGS

FIG. 6 is a table showing a relationship of the diameter of a tubular passageway according to Embodiment 3 with the number of teeth forming the serrated edge of the through hole in the flow guide plate, the diameter of a tip circle, the diameter of a root circle, and noise value;

FIG. 9 is a table showing a relationship of the dihedral angle with noise value according to Embodiment 4;

FIG. 10 is a table showing a relationship of the number of teeth with noise value according to Embodiment 4 when the dihedral angle is 150 degrees;

DETAILED DESCRIPTION

Hereinafter, embodiments according to the present disclosure are described with reference to the accompanying drawings.

The embodiments pertain to a spraying apparatus which atomizes and sprays a liquid using a gas. Examples of the gas include an air, nitrogen, oxygen, and inert gas. The gas for use may be selected appropriately, according to an intended use of the spraying apparatus. Examples of the liquid include water, ozonated water, chemical solutions having bactericiding and disinfecting capabilities, paints, and fuel oils. The liquid for use may be selected appropriately, according to an intended use of the spraying apparatus.

Embodiment 1

Figure 1A:
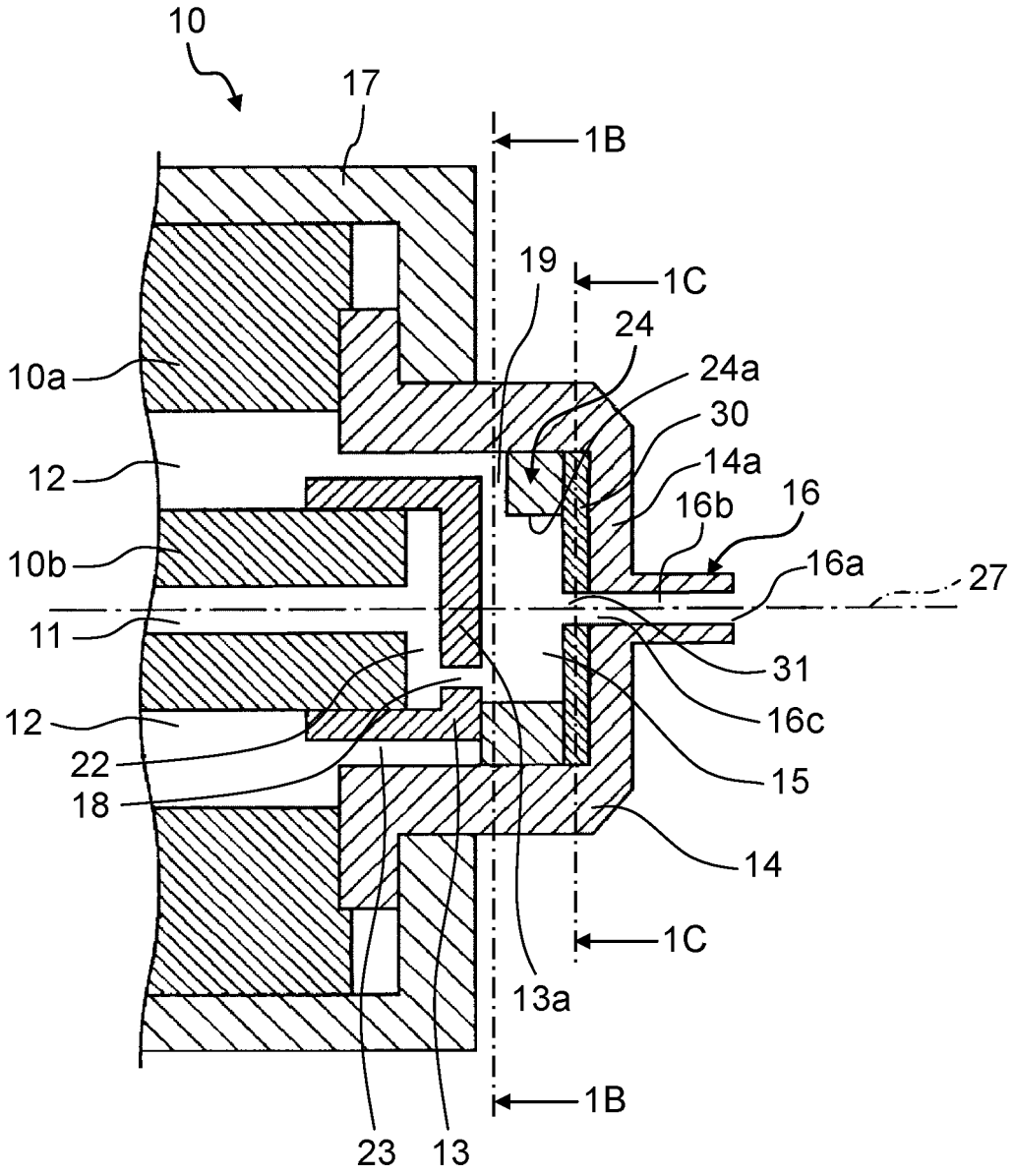
FIG. 1A is a cross-sectional end view of spraying apparatus 10 according to Embodiment 1 of the present disclosure.

FIG. 1A is a cross-sectional end view of spraying apparatus 10 according to Embodiment 1 of the present disclosure. In the following, a configuration of spraying apparatus 10 is described with reference to FIG. 1A.

Spraying apparatus 10 includes, at least, spraying apparatus main body 10*a*, inner lid 13, and outer lid 14. Inner lid 13, annular member 24, flow guide plate 30, and outer lid 14 form gas-liquid mixing section 15. Spraying apparatus 10 further includes spraying apparatus lid securing part 17.

Spraying apparatus main body 10*a* is a cylindrical member and has first liquid passageway 11 and gas passageway 12. First liquid passageway 11 is formed along the direction of central axis 27. Gas passageway 12 is in a cylindrical shape and formed spaced from and around first liquid passageway 11 along the direction of central axis 27. First liquid passageway 11 and gas passageway 12 are partitioned by cylinder 10*b* which is a portion of spraying apparatus main body 10*a* and located in the middle. Only the distal end portion of first liquid passageway 11 is shown. A liquid supply port not shown is provided at the proximal end portion of first liquid passageway 11, and is, for example, connected via a liquid supply conduit to a pump connected to a liquid reservoir. Only the distal end side of gas passageway 12 is shown. A gas supply port not shown is provided at the proximal end of gas passageway 12, and is, for example, connected via a gas supply conduit to a pneumatic pressure source configured of an air compressor.

The tip of cylinder 10*b* projects to the distal end side of spraying apparatus 10 slightly more than the portion of spraying apparatus main body 10*a* not including cylinder 10*b*. Inner lid 13 is secured to the tip of cylinder 10*b*.

Inner lid 13 covers the opening of first liquid passageway 11. Inner lid 13 includes flat inner lid plate 13*a* and has a generally C-shaped cross section in the direction of central axis 27. Second liquid passageway 22 in a disc shape is formed between an end face of cylinder 10*b* and the internal surface of inner lid plate 13*a* of inner lid 13. Liquid inlet 18 is formed in an edge portion of inner lid plate 13*a*, liquid inlet 18 passing through inner lid plate 13*a* of inner lid 13 along the direction of central axis 27. To be more specific, liquid inlet 18 passes through inner lid 13 in an edge portion of inner lid 13. For example, liquid inlet 18 is located proximate the internal surface of annular projection 24, and communicating between first liquid passageway 11 and gas-liquid mixing section 15 to introduce liquid through first liquid passageway 11 into gas-liquid mixing section 15.

Outer lid 14 is disposed on the tip of spraying apparatus main body 10*a*, covering inner lid 13 and the opening of gas passageway 12. Outer lid 14 has a generally Ω-shaped cross section in the direction of central axis 27, and includes flat outer lid plate 14*a* facing inner lid plate 13*a* of inner lid 13. Outer lid 14 covers inner lid 13 such that second space 23 in a cylindrical profile is formed uniform between outer lid 14 and inner lid 13.

Thin, disc-shaped flow guide plate 30 which has through hole 31 in the center is matingly engaged with the internal surface of outer lid 14, the internal surface being on the distal end side of spraying apparatus 10. Through hole 31 has the same diameter as the inner diameter of tubular passageway 16*b* described below.

Annular member 24 is fixed between inner lid 13 and flow guide plate 30 on outer lid 14. Specifically, annular member 24 is fixed between the external surface of inner lid plate 13*a* of inner lid 13 and flow guide plate 30. Annular member 24 has a C-shaped plane in a cross section taken along the line 1B-1B, and has hole 24*a* having a greater diameter than the diameter of through hole 31. Annular member 24 and flow guide plate 30 form gas-liquid mixing section 15 in a disc-shaped profile. Annular member 24 has a notch or an opening forming gas inlet 19.

Figure 1B:
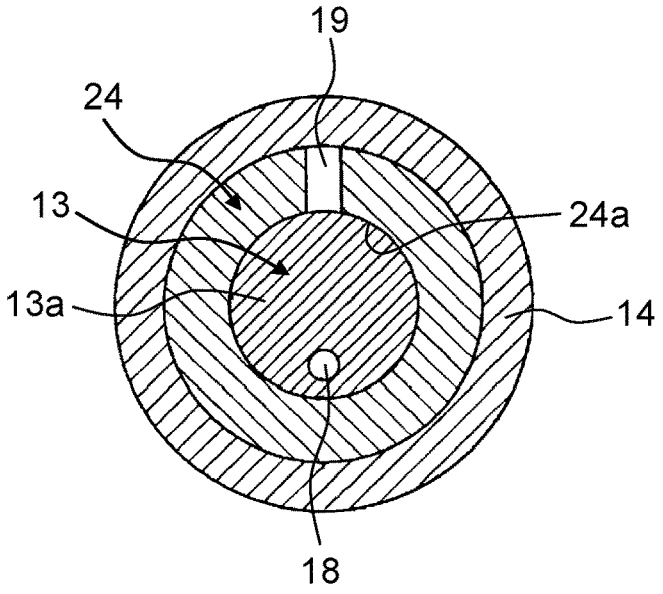
FIG. 1B is a cross-sectional view of spraying apparatus 10 according to Embodiment 1, taken along a line 1B-1B in FIG. 1A.

FIG. 1B is a cross-sectional view of spraying apparatus 10, taken along the line 1B-1B in FIG. 1A. As illustrated in FIGS. 1A and 1B, gas inlet 19 is located 180 degrees from liquid inlet 18 about the center (central axis 27) of spraying apparatus main body 10*a*. Stated differently, gas inlet 19 and liquid inlet 18 are located on opposite sides relative to the center (central axis 27) of spraying apparatus main body 10*a*. Thus, outer lid 14 is securely sandwiched between an end face of spraying apparatus main body 10*a* and spraying apparatus lid securing part 17, covering inner lid 13, annular member 24, and flow guide plate 30. It should be noted that spraying apparatus lid securing part 17 may be omitted, and outer lid 14 may instead be secured directly to the end face of spraying apparatus main body 10*a*.

In order to securely form gas-liquid mixing section 15 in the disc-shaped profile and uniform between outer lid 14 and inner lid 13 as such, annular member 24 and flow guide plate 30 are provided so that gas-liquid mixing section 15, which is the space, is formed in hole 24*a* of annular member 24 and between an internal surface of flow guide plate 30 and inner lid plate 13*a* of inner lid 13.

Figure 1C:
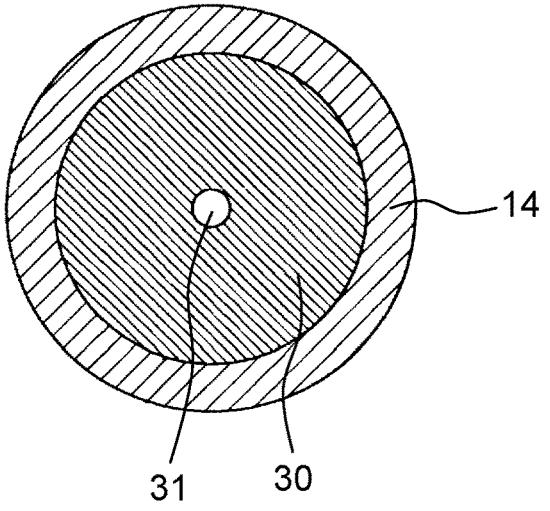
FIG. 1C is a cross-sectional view of spraying apparatus 10 according to Embodiment 1, taken along a line 1C-1C in FIG. 1A.

FIG. 1C is a cross-sectional view of spraying apparatus 10 taken along a line 1C-1C in FIG. 1A. As illustrated in FIGS. 1A and 1C, through hole 31 in flow guide plate 30 has a circular edge. Gas-liquid mixing section 15 thus configured is for mixing gas that enters through gas passageway 12 and liquid that enters through first liquid passageway 11.

As illustrated in FIG. 1A, gas inlet 19 is communicating with gas-liquid mixing section 15 between inner lid 13 and outer lid 14, and introduces the gas through gas passageway 12 into gas-liquid mixing section 15 to the liquid that entered gas-liquid mixing section 15 through liquid inlet 18. For example, gas inlet 19 is located 180 degrees from liquid inlet 18 about the center (central axis 27) of spraying apparatus main body 10*a*. Stated differently, gas inlet 19 and liquid inlet 18 are located on opposite sides relative to the center (central axis 27) of spraying apparatus main body 10*a*. Further, spouting portion 16 in a cylindrical shape is formed projecting from and secured to the center of the external surface of outer lid plate 14*a* of outer lid 14. Spouting portion 16 has tubular passageway 16*b*, gas-liquid mixed fluid inlet 16*c*, and spout 16*a* which passes through spouting portion 16 and outer lid plate 14*a* along the direction of central axis 27. Stated differently, spouting portion 16 passes through lid plate 14*a* of outer lid 14 and communicates with gas-liquid mixing section 15 and through hole 31 in flow guide plate 30. Liquid atomized by the gas and the liquid being mixed in the gas-liquid mixing section is rectified by through hole 31 in flow guide plate 30, and spouted out from spouting portion 16. Spout 16*a*, tubular passageway 16*b*, gas-liquid mixed fluid inlet 16*c*, and through hole 31 having the circular edge in flow guide plate 30 are arranged along central axis 27 along which first liquid passageway 11 is formed. Liquid inlet 18, on the other hand, is located offset from central axis 27.

Thus, gas-liquid mixing section 15 is defined by annular member 24, inner lid 13, and flow guide plate 30, and communicates between: liquid inlet 18 passing through inner lid 13 along the direction of central axis 27; gas inlet 19 formed in annular member 24 and extends along the direction (e.g., radial direction) intersecting with the direction of central axis 27; through hole 31 having the circular edge in flow guide plate 30; and spout 16*a* passing through outer lid 14 along the direction of central axis 27.

In such a configuration, liquid supplied to spraying apparatus 10 enters spraying apparatus main body 10*a* through the liquid supply port not shown, transforms into a liquid flow as it flows through first liquid passageway 11 toward the distal end of spraying apparatus 10, and the liquid flow passes through second liquid passageway 22 and liquid inlet 18 and is supplied into gas-liquid mixing section 15. Gas supplied to spraying apparatus 10 enters spraying apparatus main body 10*a* through the gas supply port not shown, transforms into a gas flow as it flows through gas passageway 12 toward the distal end of spraying apparatus 10, and the gas flow passes through space 23 and gas inlet 19 and is supplied into gas-liquid mixing section 15.

The gas and liquid supplied in gas-liquid mixing section 15 are mixed together, thereby atomizing the liquid into a gas-liquid mixed mist. The atomized liquid is thereafter rectified as it passes through through hole 31 having the circular edge in flow guide plate 30, and then the gas-liquid mixed mist passes through gas-liquid mixed fluid inlet 16*c* and tubular passageway 16*b* of spouting portion 16 on outer lid 14 and spouts from spout 16*a*.

In the following, the mechanism for atomizing the liquid in gas-liquid mixing section 15 is described with reference to FIGS. 1A and 1B. The liquid through first liquid passageway 11 passes through second liquid passageway 22 and passes through liquid inlet 18 formed in inner lid 13, enters gas-liquid mixing section 15 along the internal surface of hole 24*a* of annular member 24 toward spouting portion 16.

Meanwhile, the gas passes through gas inlet 19 facing liquid inlet 18 across central axis 27, and is supplied in gas-liquid mixing section 15. The gas impinges, in gas-liquid mixing section 15, with the liquid supplied from liquid inlet 18. The liquid impinged with the gas as such spreads out to the inner surface (internal surface) of hole 24*a* of annular member 24 and transforms into a thin film. The thin film of liquid further flows in a circumferential direction along the internal surface of hole 24*a* of annular member 24, and thereby further transforms from the thin film to fine water droplets. Still further, a gas-liquid mixed fluid comprising the water droplets is aggregated in gas-liquid mixing section 15. As a result, the water droplets can further be atomized, allowing a liquid having a small particle size to be sprayed from spout 16*a*.

Specifically, spraying apparatus 10 includes: gas-liquid mixing section 15 having an inner diameter of 6.0 mm and a height of 2.0 mm: flow guide plate 30 having a thickness of 0.5 mm and circular edged through hole 31 having a diameter of 1.0 mm; spouting portion 16 including spout 16*a* and gas-liquid mixed fluid inlet 16*c* each having a diameter of 1.0 mm; tubular passageway 16*b* having a diameter of 1.0 mm and a length of 3.0 mm; liquid inlet 18 having a diameter of 0.7 mm; and rectangular gas inlet 19 having a width of 1.0 mm and a height of 1.0 mm.

Spraying apparatus 10 was supplied with a compressed air, which is an example of the gas, pressurized by 0.3 MPa (gauge pressure) and a water, which is an example of the liquid, pressurized by 0.26 MPa (gauge pressure). A Sauter mean diameter of the water atomized under the above conditions was evaluated by a laser diffraction technique. A measurement according to the laser diffraction technique was carried out on atomized water 300 mm away from the tip of spraying apparatus 10, and Sauter mean diameter evaluated was 10.0 μm. Moreover, noise at a location 1000 mm away from the tip of spraying apparatus 10 under the above conditions was measured, indicating a noise value of 80 dB.

According to spraying apparatus 10 of Embodiment 1, gas-liquid mixing section 15 that is in the disc-shaped profile and uniform between outer lid 14 and inner lid 13 is securely formed by providing annular member 24 and flow guide plate 30 between inner lid 13 and outer lid 14. Thus, in gas-liquid mixing section 15, gas through gas inlet 19 impinges in a vertically downward direction with liquid through liquid inlet 18 and spreads out on the internal surface of hole 24*a* of annular member 24, by which the liquid is circulated and aggregated along the internal surface and atomized, thereby allowing the atomized liquid to be rectified by through hole 31 in flow guide plate 30 and spout from spouting portion 16. As a result, spraying apparatus 10 is provided which sprays a liquid which has a small particle size and vaporizes so quickly that an object sprayed with the liquid does not get dripping wet. More specifically, two-fluid nozzle spraying apparatus 10 is provided which sprays a liquid which has a small particle size such as 10 μm or less and vaporizes so quickly that an object sprayed with the liquid does not get dripping wet.

Gas inlet 19 according to Embodiment 1 is disposed at a position facing liquid inlet 18 across central axis 27 of spraying apparatus main body 10*a*. However, the arrangement of gas inlet 19 is not limited thereto. For example, gas inlet 19 may be located proximate liquid inlet 18 in a manner that a flow of the liquid out of liquid inlet 18 and a flow of the gas out of gas inlet 19 intersect. Further, a plurality of gas inlets 19 and a plurality of liquid inlets 18 may be arranged.

Moreover, disc-shaped projection may be formed on inner lid plate 13*a* of inner lid 13 so as to be located proximate liquid inlet 18 and have a width in a direction perpendicular to the line 1B-1B less than a width of gas-liquid mixing section 15 in the direction.

Embodiment 2

Figure 2:
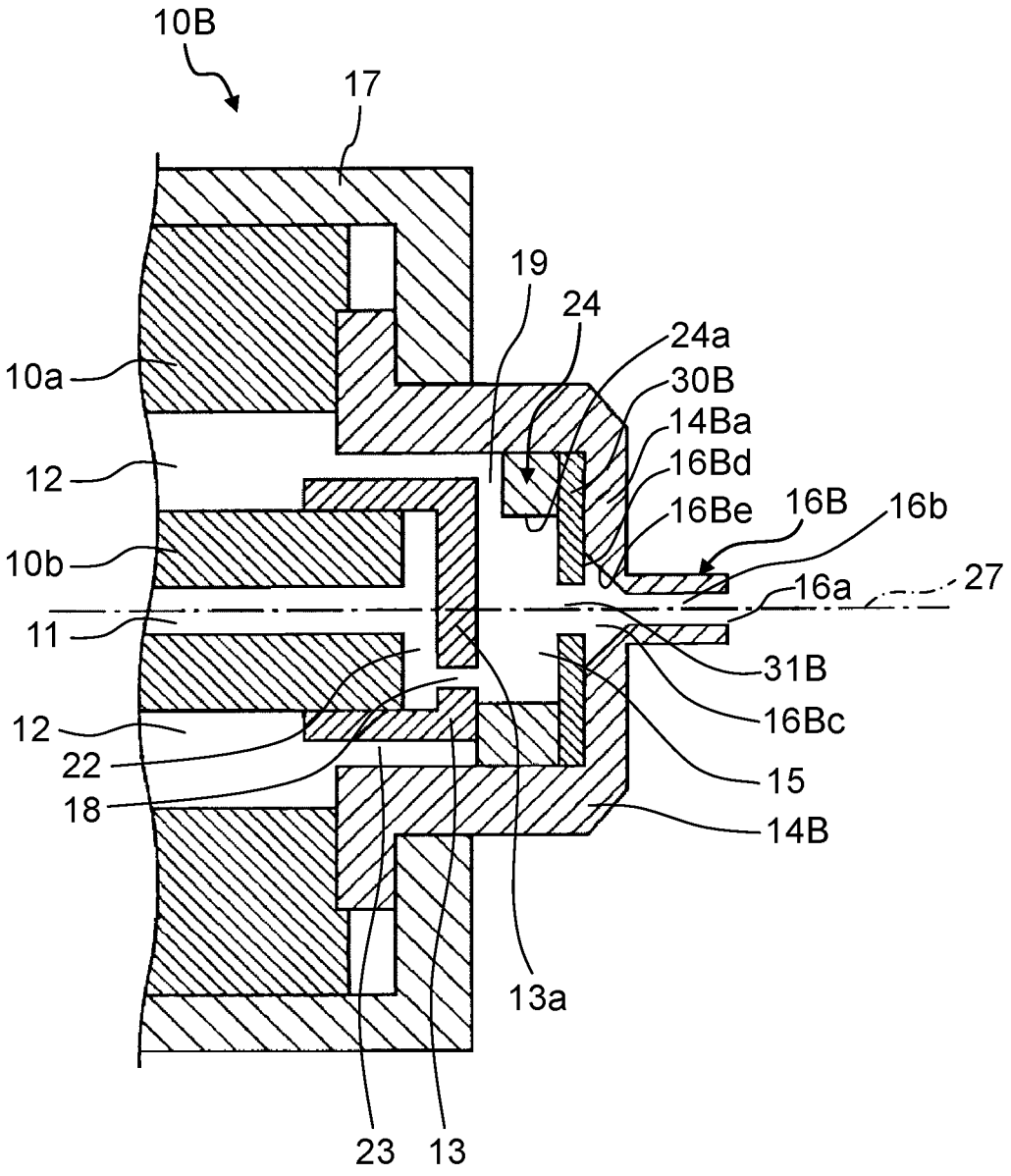
FIG. 2 is a cross-sectional end view of spraying apparatus 10B according to Embodiment 2 of the present disclosure.

FIG. 2 is a cross-sectional end view of spraying apparatus 10B according to Embodiment 2, which includes frustoconical gas-liquid mixed fluid inlet 16Bc. As illustrated in FIG. 2, gas-liquid mixed fluid inlet 16Bc has opening 16Bd having a greater diameter than through hole 31B, and is in a frustoconical shape defined by sloped conical surface 16Be that decreases in diameter from opening 16Bd toward spout 16*a*. The purpose of frustoconical gas-liquid mixed fluid inlet 16Bc is to further atomize the liquid. As the gas and the liquid are supplied into gas-liquid mixing section 15, they are mixed together in gas-liquid mixing section 15 so that the liquid is atomized, after which the liquid is rectified as it passes through through hole 31B formed in flow guide plate 30B, through hole 31B having a circular edge. Then, the mixed, atomized liquid passes through gas-liquid mixed fluid inlet 16Bc and tubular passageway 16*b* in spouting portion 16B formed on outer lid 14B and spouts out through spout 16*a*. Owing to gas-liquid mixed fluid inlet 16Bc being frustoconical, the gas-liquid mixed fluid flowing toward spout 16*a* is rectified as it passes through hole 31B, which has the circular edge and formed in flow guide plate 30B, and spreads out in opening 16Bd having the greater diameter than the diameter of through hole 31B, and the flow rate decreases. The flow of gas-liquid mixed fluid is then gradually constricted along conical surface 16Be, thereby causing the atomized water droplets less likely to gather before reaching spout 16*a*. As a result, the water droplets in the gas-liquid mixed fluid can be sprayed through spout 16*a*, while being kept atomized. Preferably, a maximum diameter of the entrance side of frustoconical gas-liquid mixed fluid inlet 16Bc is less than or equal to the diameter of hole 24*a* in annular member 24, and is twice the diameter of tubular passageway 16*b* or greater. More preferably, the maximum diameter of the entrance side of frustoconical gas-liquid mixed fluid inlet 16Bc is twice to four times the diameter of tubular passageway 16*b*.

As a specific example, frustoconical gas-liquid mixed fluid inlet 16Bc has an entrance side whose maximum diameter is 3.0 mm, and tubular passageway 16*b* has a diameter of 1.0 mm and a length of 2.0 mm.

Spraying apparatus 10B was measured under the same conditions as Embodiment 1, indicating a Sauter mean diameter of 9.0 μm and a noise value of 80 dB.

Embodiment 3

Figure 3:
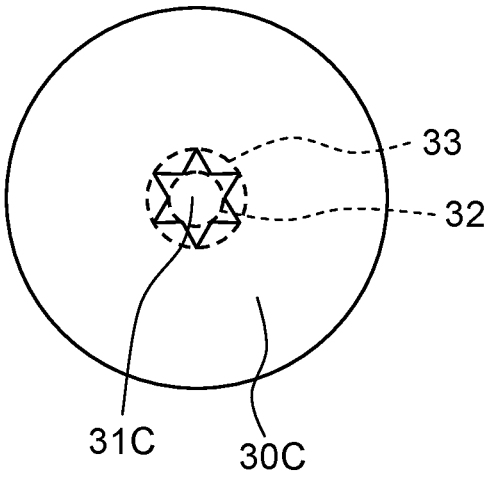
FIG. 3 is a diagram illustrating a flow guide plate having a through hole whose edge is serrated with six teeth according to Embodiment 3 of the present disclosure.
Figure 4:
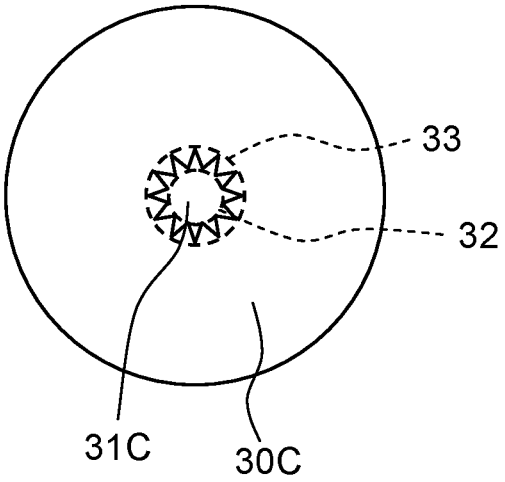
FIG. 4 is a diagram illustrating a flow guide plate having a through hole whose edge is serrated with twelve teeth according to Embodiment 3.

FIGS. 3 and 4 are diagrams illustrating flow guide plate 30C having through hole 31C whose edge is serrated according to Embodiment 3. Here, FIG. 3 shows flow guide plate 30C having through hole 31C whose edge is serrated with six teeth. FIG. 4 shows flow guide plate 30C having through hole 31C whose edge is serrated with twelve teeth.

The purpose of the serrated edge of through hole 31C in flow guide plate 30C is to reduce noise that is generated when gas-liquid mixed fluid comprising atomized liquid spouts out through spraying apparatus 10 (see FIG. 1), 10B (see FIG. 2) according to the above embodiments. A gas-liquid mixed fluid jet spouting at a high velocity through spraying apparatus 10, 10B causes friction with ambient air and turbulence is formed between the gas-liquid mixed fluid jet and ambient air, thereby generating the noise. The flow rate at which the gas-liquid mixed fluid comprising atomized water spouts from spout 16*a* is not relatively uniform in a vicinity of spout 16*a*. Through hole 31C having a serrated edge, formed in flow guide plate 30C, causes varying spout velocities in the vicinity of spout 16*a*, thereby reducing the turbulence formed between the gas-liquid mixed fluid jet and ambient air. This allows a reduction of noise.

Figure 5:
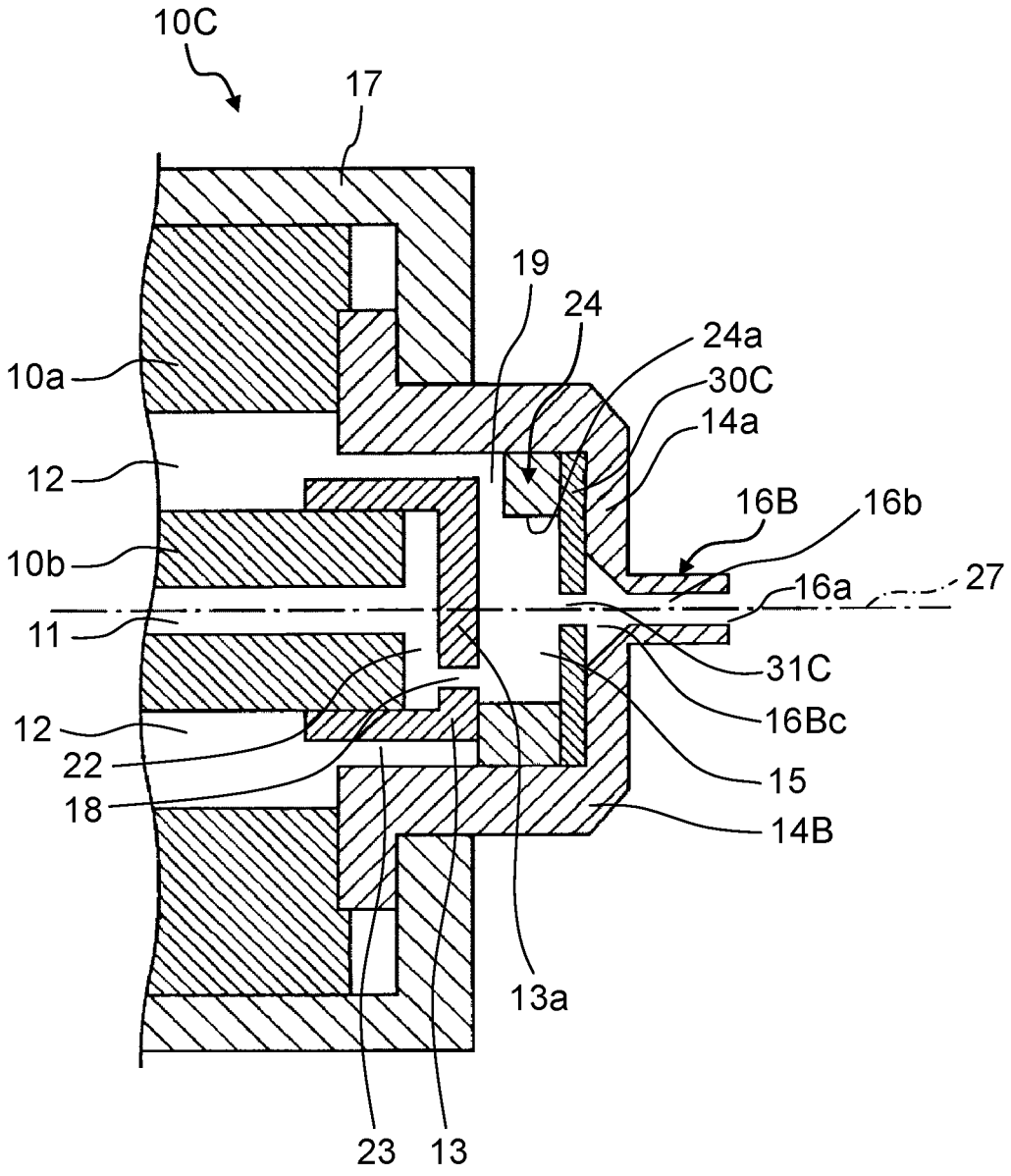
FIG. 5 is a cross-sectional end view of spraying apparatus 10C according to Embodiment 3.

FIG. 5 is a cross-sectional end view of spraying apparatus 10C according to Embodiment 3. Spraying apparatus 10C is the same as spraying apparatus 10B (see FIG. 2) according to Embodiment 2, except that spraying apparatus 10C includes flow guide plate 30C (see FIG. 3), in place of flow guide plate 30. Specifically, flow guide plate 30C has a thickness of 0.5 mm, the edge of through hole 31C in flow guide plate 30C is serrated with six teeth, the tip circle has a diameter of 1.0 mm, and the root circle has a diameter of 1.7 mm.

Spraying apparatus 10C illustrated in FIG. 5 was measured under the same conditions as Embodiment 1, indicating a Sauter mean diameter of 9.0 μm and a noise value of 75 dB.

The relationship of the diameter of tubular passageway 16*b* with the number and size of the teeth with which the edge of through hole 31C is serrated in flow guide plate 30C, and the noise value is shown in FIG. 6.

Specifically, noise values were measured for tip circle 32 in different diameters and root circle 33 in different diameters in spraying apparatus 10C illustrated in FIG. 5, provided that the diameter of tubular passageway 16*b* is 1.0 mm and 1.5 mm and flow guide plate 30C having a thickness of 0.5 mm has through hole 31C whose edge is serrated with six teeth (see FIG. 3) and with twelve teeth (see FIG. 4).

The noise value was small when tip circle 32 and tubular passageway 16*b* were close in diameter. As the diameter of tip circle 32 was increased, the noise value increased. The noise value remained substantially at a constant value when the diameter of tip circle 32 exceeded half the diameter (6.0 mm) of gas-liquid mixing section 15 in the disc-shaped profile. Tip circle 32 smaller in diameter than tubular passageway 16*b* is not preferable because it resists the flow of the gas-liquid mixed fluid, thereby reducing the flow of the gas-liquid mixed fluid and increasing the Sauter mean diameter. Comparing the cases where through hole 31C has the edge serrated with six teeth and with twelve teeth, the relationship of the diameter of tip circle 32 with the noise value changed in a similar way.

Moreover, similar to what was obtained when the diameter of tubular passageway 16*b* was 1.0 mm, the noise value when the diameter of tubular passageway 16*b* was 1.5 mm was small when tip circle 32 and tubular passageway 16*b* were close in diameter, and the noise value was increased with an increase of the diameter of tip circle 32.

Thus, the noise value can be reduced if the diameter of tip circle 32 is greater than or equal to the diameter of tubular passageway 16*b* and the diameter of root circle 33 is less than or equal to half the diameter of gas-liquid mixing section 15 in the disc-shaped profile.

The noise value can further be reduced when the diameter of tip circle 32 is greater than or equal to the diameter of tubular passageway 16*b* and the diameter of root circle 33 is ⅓ the diameter of gas-liquid mixing section 15 in the disc-shaped profile. It should be noted that flow guide plate 30C according to Embodiment 3 may be used, in place of flow guide plate 30 in spraying apparatus 10 according to Embodiment 1. Such a spraying apparatus was measured under the same conditions as Embodiment 1, provided that flow guide plate 30C has a thickness of 0.5 mm, flow guide plate 30C has through hole 31C whose edge is serrated with six teeth, the tip circle has a diameter of 1.0 mm, and the root circle has a diameter of 1.7 mm. The measurement indicated a Sauter mean diameter of 10.0 μm and a noise value of 75 dB.

As such according to the spraying apparatus of Embodiments 1 through 3, in gas-liquid mixing section 15 formed between inner lid 13 and flow guide plate 30, 30B, or 30C, liquid through liquid inlet 18 impinges with gas through gas inlet 19, and the liquid spreads out to the inner surface (internal surface) of hole 24*a* of annular member 24 and transforms into a thin film. The thin film of liquid flows along the internal surface in the circumferential direction of annular member 24, and thereby further transforms from the thin film to fine water droplets. Still further, a gas-liquid mixed fluid comprising the water droplets is aggregated in gas-liquid mixing section 15. As a result, the liquid is atomized, allowing the atomized water to be spouted from spouting portion 16B.

Moreover, according to the spraying apparatus of Embodiments 2 and 3, owing to gas-liquid mixed fluid inlet 16Bc being frustoconical, the atomized water droplets are caused less likely to gather before reaching spout 16*a*, thereby allowing further atomized water droplets to be spouted from spouting portion 16B.

Further, according to the spraying apparatus of Embodiment 3, gas-liquid mixed fluid comprising atomized liquid is passed through through hole 31C having the serrated edge in flow guide plate 30C, thereby reducing turbulence formed between a gas-liquid mixed fluid jet and ambient air and allowing the atomized liquid to be spouted from spouting portion 16B at reduced noise.

As a result, the spraying apparatus is provided which sprays a liquid which has a small particle size and vaporizes so quickly that an object sprayed with the liquid does not get dripping wet. More specifically, the two-fluid nozzle spraying apparatus can be provided which sprays, with a reduced noise, a liquid which has a small particle size such as 10 μm or less and vaporizes so quickly that an object sprayed with the liquid does not get dripping wet.

Embodiment 4

A spraying apparatus according to Embodiment 4 includes flow guide plate 30D having a configuration different from flow guide plate 30 according to the above embodiments. Through hole 31D has an edge serrated with triangular teeth 34 which are angled relative to gas-liquid mixing section side surface 30Da that is demarcated between root circle 33 and perimeter 35 of flow guide plate 30D.

Figure 7A:
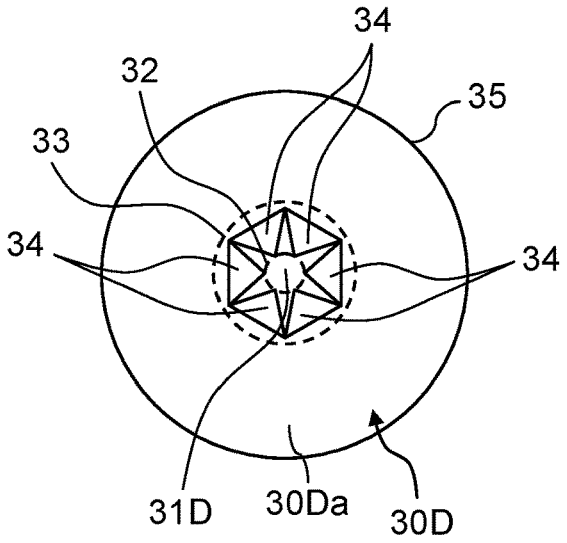
FIG. 7A is a diagram illustrating a flow guide plate having a through hole which has a serrated edge according to Embodiment 4 of the present disclosure.
Figure 7B:
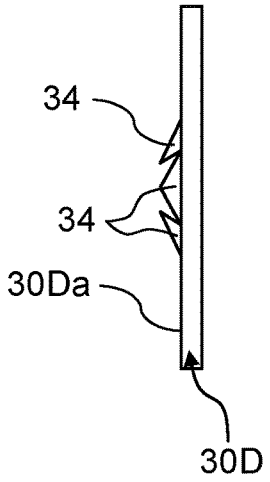
FIG. 7B is a side view of the flow guide plate having a through hole which has a serrated edge according to Embodiment 4.
Figure 7C:
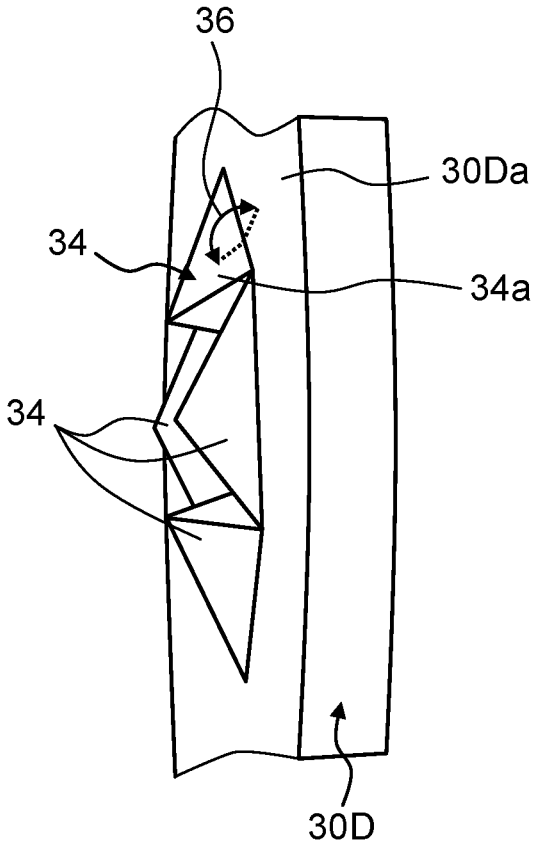
FIG. 7C is a close-up perspective view of the through hole having the serrated edge in the flow guide plate according to Embodiment 4.
Figure 7D:
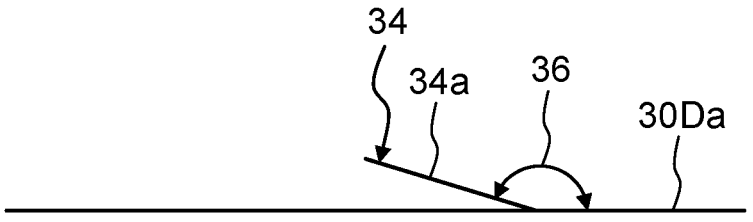
FIG. 7D is a diagram for illustrating a dihedral angle between a tooth and the flow guide plate according to Embodiment 4.

FIG. 7A is a diagram illustrating flow guide plate 30D according to Embodiment 4. FIG. 7B is a side view of flow guide plate 30D. FIG. 7C is a close-up perspective view of through hole 31D which has the serrated edge and formed in flow guide plate 30D. FIG. 7D is a diagram illustrating dihedral angle 36 formed between gas-liquid mixing section side surface 30Da and one of teeth 34, for illustrating dihedral angle 36 between tooth 34 and flow guide plate 30D.

In flow guide plate 30D, an angle between: gas-liquid mixing section side surface 34*a* of one of teeth 34 with which the edge of through hole 31D is serrated; and gas-liquid mixing section side surface 30Da demarcated by root circle 33 and perimeter 35 of flow guide plate 30D, is defined as dihedral angle 36 (see FIGS. 7C and 7D). To be more specific, dihedral angle 36 is formed between adjacent two surfaces 34*a* and 30Da. Herein, as an example, dihedral angle 36 is less than or equal to 180 degrees.

The purpose of angled teeth 34 of flow guide plate 30D is to further reduce the noise that is generated when the gas-liquid mixed fluid comprising the atomized liquid spouts out through the spraying apparatus according to the above embodiments. Teeth 34 being angled allows the flow of the gas-liquid mixed fluid to strike to surfaces 34*a* of teeth 34 at approximately perpendicular angles as the flow is constricted from gas-liquid mixing section 15 toward spout 16*a*, thereby further reducing turbulence formed between the gas-liquid mixed fluid jet and ambient air. This allows further reduction of noise.

Figure 8:
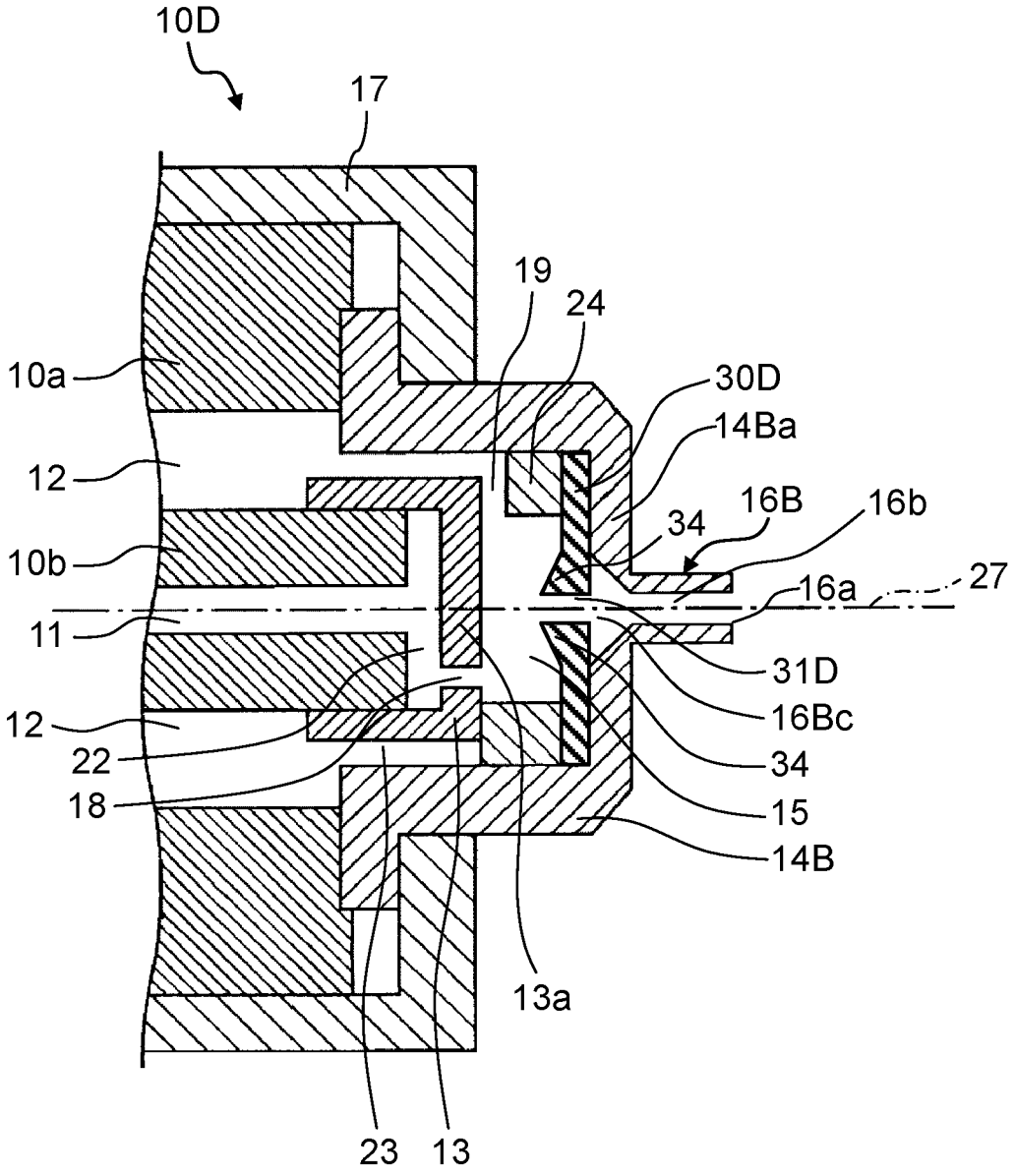
FIG. 8 is a cross-sectional end view of spraying apparatus 10D according to Embodiment 4.

FIG. 8 is a cross-sectional end view of spraying apparatus 10D according to Embodiment 4. Spraying apparatus 10D is the same as spraying apparatus 10B (see FIG. 2) according to Embodiment 2, except that spraying apparatus 10D includes flow guide plate 30D (see FIG. 7A), in place of flow guide plate 30. Specifically, flow guide plate 30D has a thickness of 0.5 mm, the edge of through hole 31D in flow guide plate 30D is serrated with six teeth, the tip circle has a diameter of 1.6 mm, the root circle has a diameter of 2.6 mm, and dihedral angle 36 is 150 degrees.

Spraying apparatus 10D illustrated in FIG. 8 was measured under the same conditions as Embodiment 1, indicating a Sauter mean diameter of 9.0 μm and a noise value of 72 dB.

The relationship between dihedral angle 36 and the noise value is shown in FIG. 9. As dihedral angle 36 was decreased from 180 degrees, the noise value decreased, indicating that the noise value is minimum when dihedral angle 36 is in a range from 150 degrees to 120 degrees. As dihedral angle 36 was decreased from 120 degrees to 90 degrees, the noise value increased, indicating that the noise value when dihedral angle 36 was 90 degrees was the same as when dihedral angle 36 was 180 degrees. When dihedral angle 36 was less than 90 degrees, the noise value increased greater than when dihedral angle 36 was 180 degrees. The noise value is small and preferable when dihedral angle 36 is greater than or equal to 90 degrees and less than or equal to 180 degrees. The noise value is minimum and more preferable when dihedral angle 36 is greater than or equal to 120 degrees and less than or equal to 150 degrees.

FIG. 10 shows the relationship of the number of teeth with the noise value when dihedral angle 36 is 150 degrees. As the number of teeth was increased when dihedral angle 36 was 150 degrees, the noise value decreased. There was no difference in noise value between three continued teeth and three discontinued teeth when dihedral angle 36 was 150 degrees.

Figure 11A:
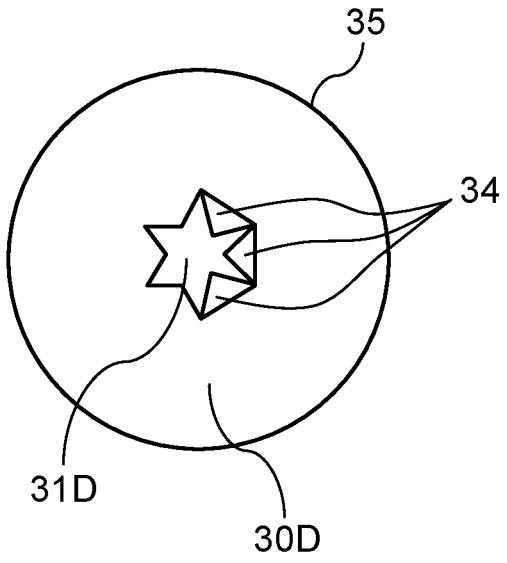
FIG. 11A is a diagram illustrating a flow guide plate having continued three teeth according to a variation of Embodiment 4m when the dihedral angle is 150 degrees.
Figure 11B:
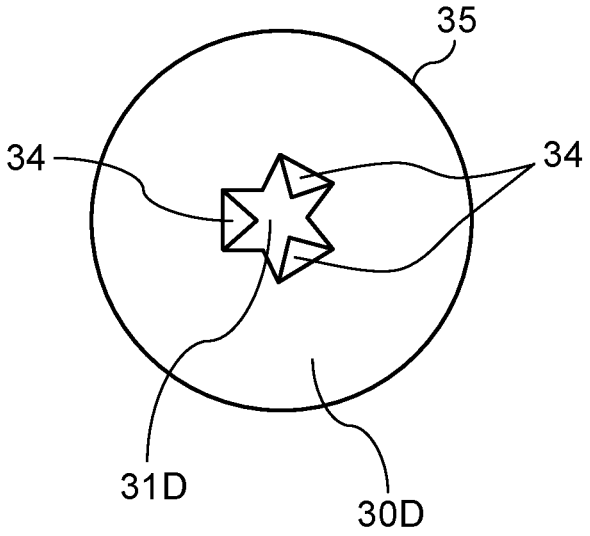
FIG. 11B is a diagram illustrating a flow guide plate having discontinued three teeth according to a variation of Embodiment 4 when the dihedral angle is 150 degrees.
Figure 12:
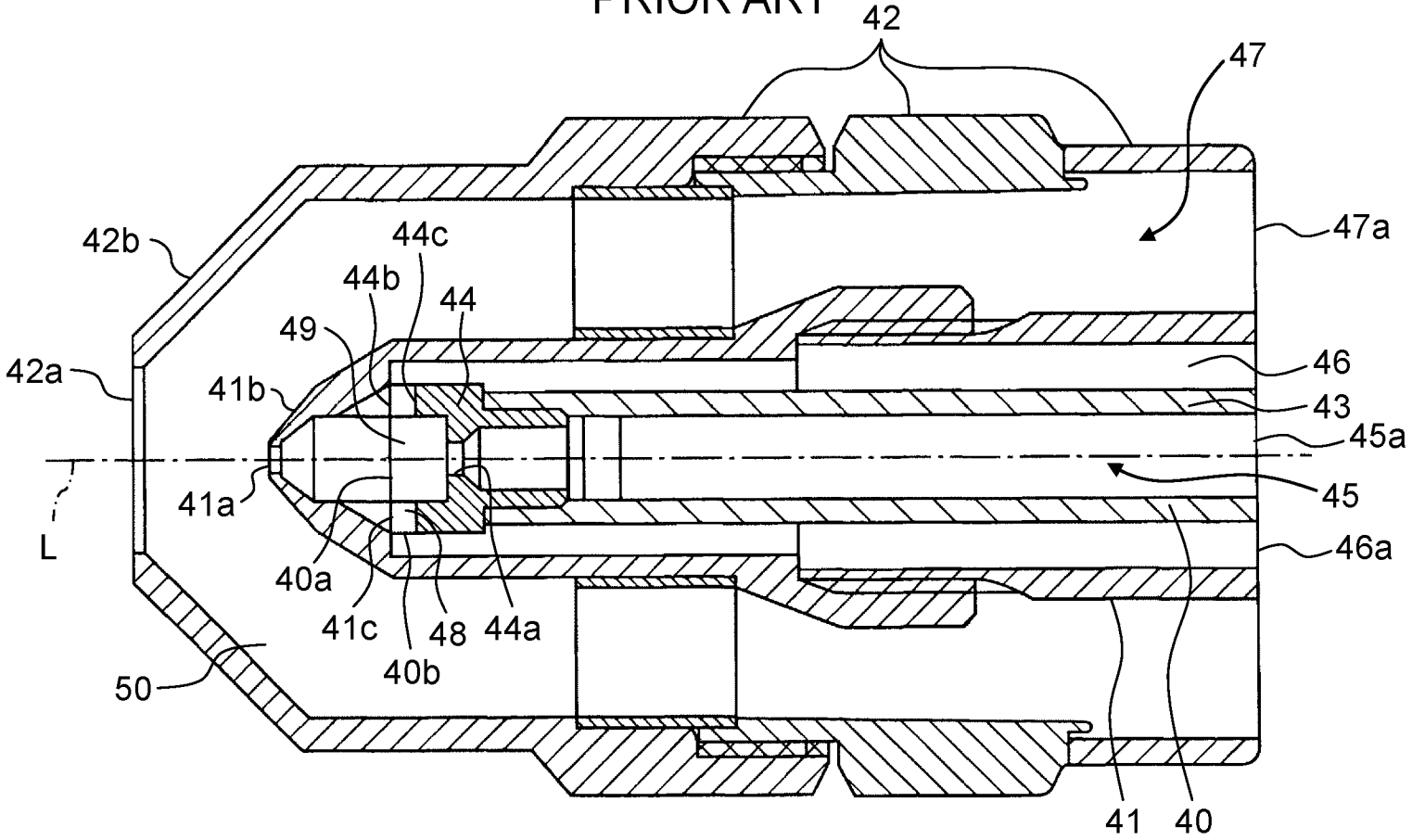
FIG. 12 PRIOR ART
FIG. 12 is a cross-sectional view showing a schematic illustration of a conventional spraying apparatus.

FIG. 11A illustrates a variation of Embodiment 4 in which flow guide plate 30D has three continued teeth each having dihedral angle 36 of 150 degrees. FIG. 11B illustrates flow guide plate 30D having three discontinued teeth spaced apart and each having dihedral angle 36 of 150 degrees. Configuring at least one or more of teeth 34 to have dihedral angle 36 of 150 degrees yields the effects of reducing the noise.

While six teeth 34 are illustrated by way of example in Embodiment 4, the number of teeth 34 is not limited thereto.

According to the spraying apparatus of Embodiment 4, teeth 34 of flow guide plate 30D are angled so that dihedral angle 36 between flow guide plate 30D and each of teeth 34 is greater than or equal to 90 degrees and less than or equal to 180 degrees. Thus, noise that is generated when the gas-liquid mixed fluid comprising atomized liquid spouts out of the spraying apparatus can further be reduced. It should be noted that flow guide plate 30D according to Embodiment 4 may be used, in place of flow guide plate 30 in spraying apparatus 10 according to Embodiment 1. Such a spraying apparatus was measured under the same conditions as Embodiment 1, provided that flow guide plate 30D has a thickness of 0.5 mm, flow guide plate 30D has through hole 31D whose edge is serrated with six teeth, the tip circle has a diameter of 1.6 mm, the root circle has a diameter of 2.6 mm, and dihedral angle 36 is 150 degrees. The measurement indicated a Sauter mean diameter of 10.0 μm and a noise value of 72 dB.

Among the various embodiments described above, any embodiments may be combined as appropriate to yield the advantageous effects of the respective embodiments. In addition to combining any embodiments, features of the different embodiments may be combined.

The spraying apparatus according to the above aspect of the present disclosure is a spraying apparatus which sprays a liquid having a small particle size such as about 10 μm or less. The spraying apparatus according to the above aspect of the present disclosure is widely applicable, for example, to cooling a space or material, humidifying, dispensing a chemical solution, combustion, or dust control.

What is claimed is:

1. A spraying apparatus comprising:

a spraying apparatus main body having a liquid passageway and a gas passageway;

an inner lid which includes an inner lid plate, the inner lid being disposed on a distal end of the spraying apparatus main body and covering an opening of the liquid passageway, the inner lid plate being flat;

an outer lid which includes an outer lid plate which is flat and faces the inner lid plate of the inner lid, the outer lid being disposed on the distal end of the spraying apparatus main body and covering the inner lid and an opening of the gas passageway;

an annular member which is disposed between the inner lid and the outer lid and forms a gas-liquid mixing section which is a space and has a disc-shaped profile;

a flow guide plate disposed between the gas-liquid mixing section and the outer lid and having a through hole communicating with the gas-liquid mixing section;

a liquid inlet for introducing the liquid through the liquid passageway into the gas-liquid mixing section, the liquid inlet passing through the inner lid plate of the inner lid in an edge portion of the inner lid plate and communicating with the gas-liquid mixing section;

a gas inlet for introducing the gas through the gas passageway into the gas-liquid mixing section to the liquid that entered the gas-liquid mixing section through the liquid inlet, the gas inlet communicating with the gas-liquid mixing section; and a spouting portion for spouting a liquid atomized by the gas and the liquid being mixed in the gas-liquid mixing section, the spouting portion communicating with the gas-liquid mixing section and the through hole in the flow guide plate and passing through the outer lid plate of the outer lid.

2. The spraying apparatus according to claim 1, wherein the spouting portion is a frustoconical gas-liquid mixed fluid inlet communicating with the outer lid plate of the outer lid.

3. The spraying apparatus according to claim 2, wherein the through hole in the flow guide plate has a serrated edge.

4. The spraying apparatus according to claim 3, wherein a tip circle of the serrated edge of the through hole in the flow guide plate has a diameter greater than or equal to a diameter of a tubular passageway in the spouting portion, and a root circle of the serrated edge of the through hole has a diameter less than or equal to half a diameter of the gas-liquid mixing section.

5. The spraying apparatus according to claim 3, wherein a surface of at least one tooth included in the serrated edge of the flow guide plate in the through hole and a surface of the flow guide plate form a dihedral angle greater than or equal to 90 degrees and less than or equal to 180 degrees, the surface of the at least one tooth being on a gas-liquid mixing section side, the surface of the flow guide plate being on the gas -liquid mixing section side and demarcated by a root circle and a perimeter of the flow guide plate.

6. The spraying apparatus according to claim 5, wherein the dihedral angle is greater than or equal to 120 degrees and less than or equal to 150 degrees.

7. The spraying apparatus according to claim 1, wherein the through hole in the flow guide plate has a serrated edge.

8. The spraying apparatus according to claim 7, wherein a tip circle of the serrated edge of the through hole in the flow guide plate has a diameter greater than or equal to a diameter of a tubular passageway in the spouting portion, and a root circle of the serrated edge of the through hole has a diameter less than or equal to half a diameter of the gas-liquid mixing section.

9. The spraying apparatus according to claim 7, wherein a surface of at least one tooth included in the serrated edge of the flow guide plate in the through hole and a surface of the flow guide plate form a dihedral angle greater than or equal to 90 degrees and less than or equal to 180 degrees, the surface of the at least one tooth being on a gas-liquid mixing section side, the surface of the flow guide plate being on the gas-liquid mixing section side and demarcated by a root circle and a perimeter of the flow guide plate.

10. The spraying apparatus according to claim 9, wherein the dihedral angle is greater than or equal to 120 degrees and less than or equal to 150 degrees.

* * * * *